US008641588B2

(12) United States Patent
Verheem

(10) Patent No.: US 8,641,588 B2
(45) Date of Patent: Feb. 4, 2014

(54) ELEVATED RECLINING EXERCISE CHAIR

(76) Inventor: Johann B. Verheem, Encinitas, CA (US)

( * ) Notice: Subject to any disclaimer, the term of this patent is extended or adjusted under 35 U.S.C. 154(b) by 116 days.

(21) Appl. No.: 13/211,159

(22) Filed: Aug. 16, 2011

(65) Prior Publication Data

US 2013/0045845 A1 Feb. 21, 2013

(51) Int. Cl.
*A63B 23/02* (2006.01)

(52) U.S. Cl.
USPC ..... 482/140

(58) Field of Classification Search
USPC ..... 482/92, 116, 140, 142, 907–908
See application file for complete search history.

(56) References Cited

U.S. PATENT DOCUMENTS

| | | | | |
|---|---|---|---|---|
| 5,232,426 | A * | 8/1993 | Van Straaten | 482/123 |
| 6,213,923 | B1 * | 4/2001 | Cameron et al. | 482/142 |
| 6,283,900 | B1 * | 9/2001 | Tornabene | 482/122 |
| 7,125,366 | B1 * | 10/2006 | Yeh | 482/140 |
| 7,326,159 | B2 * | 2/2008 | Rong | 482/140 |
| 7,361,128 | B2 * | 4/2008 | Chen | 482/144 |
| 7,740,572 | B2 * | 6/2010 | Verheem | 482/142 |
| 7,749,144 | B2 * | 7/2010 | Hammer | 482/142 |
| 7,857,741 | B1 * | 12/2010 | Hsiung | 482/145 |
| 7,967,733 | B2 * | 6/2011 | Abelbeck | 482/51 |
| 7,998,039 | B1 * | 8/2011 | Wallach | 482/121 |
| 2003/0087737 | A1 | 5/2003 | Studdard | |
| 2005/0075224 | A1 * | 4/2005 | Lin | 482/130 |
| 2005/0075225 | A1 * | 4/2005 | Shin | 482/130 |
| 2005/0143233 | A1 * | 6/2005 | Shifferaw | 482/140 |
| 2005/0181916 | A1 * | 8/2005 | Frost et al. | 482/140 |
| 2008/0242517 | A1 | 10/2008 | Webber et al. | |
| 2010/0141000 | A1 | 6/2010 | Chadwick et al. | |
| 2010/0240503 | A1 | 9/2010 | Verheem | |

OTHER PUBLICATIONS

International Bureau, International Search Report for International Application No. PCT/US/2011/047970, Feb. 21, 2013, pp. 1-3, Geneva, Switzerland.

International Bureau, Written Opinion of the International Search Authority for International Application No. PCT/US2011/047970, Feb. 21, 2013, pp. 1-4, Geneva, Switzerland.

* cited by examiner

*Primary Examiner* — Loan Thanh
*Assistant Examiner* — Joshua Lee
(74) *Attorney, Agent, or Firm* — Gordon & Rees LLP; Laurie A. Axford

(57) ABSTRACT

A resistance chair includes an elevated stationary seat with a front edge and a back edge. An arm is rotatably engaged with the back edge of the seat and is rotatable to a position below horizontal with respect to the elevated stationary seat. A back support is secured to the arm and supports the back of a user sitting on the elevated stationary seat. At least one resistance element is connected to the elevated stationary seat and urges the first arm to an upright start position and assists a user performing an abdominal crunch to return to an upright abdominal crunch position from a fully extended abdominal crunch position with the arm below horizontal with respect to the elevated stationary seat. The resistance element also resists against rotation of the arm away from the upright start position and resists against the user moving from the upright abdominal crunch position to the fully extended abdominal crunch position.

8 Claims, 5 Drawing Sheets

ELEVATED RECLINING EXERCISE CHAIR

FIELD

The following description relates generally to the field of exercise equipment and more specifically to the field of low impact abdominal exercisers.

BACKGROUND

In an age of exercise and fitness, the time-honored abdominal crunch is under attack as potentially damaging if done incorrectly especially if performed by someone in poor physical condition. What is needed is an exercise tool to enable anyone to perform a correct abdominal crunch, and provide varying levels of resistance or assistance to accommodate people unaccustomed to exercise.

Additionally, there is a need for an exercise tool that enables a user to perform alternative variations of the abdominal crunch. For example, traditional abdominal crunches performed on a flat surface such as the ground only allow a user to recline to a horizontal position. In order to increase the difficulty of a traditional abdominal crunch, it would be desirable to provide a device that allows a user to recline beyond a horizontal position while still ensuring that the user maintains proper form in order to prevent injury.

SUMMARY

The devices disclosed below satisfy these and other needs. The following simplified summary is provided in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

A resistance chair with wheels assists users with performing correct abdominal crunches by guiding the user's effort and eliminating the initial jerking motion commonly experienced when doing an abdominal crunch. The resistance chair includes a seat connected to a hinged back with back support that extends to support the user's back and assist in the crunch recovery following the crunch extension.

In operation, a resistance chair provides support for a user's back, adjustable resistance moving from the start position to the extended position thus exercising muscles that ordinarily don't receive work in abdominal crunches. The back support and the adjustable resistance of the resistance chair also assist the user by overcoming a portion of gravity to help the user perform a correct crunch moving from the extended position to the start position.

By providing resistance to the backwards movement, the user engages the lower back muscles and thereby exercises the front and the back of the abdominal muscles. The backrest further permits core rotation providing the user the ability to do a sideways twist and engage the oblique muscles.

In another embodiment, a resistance chair includes an elevated stationary seat with a front edge and a back edge. An arm is rotatably engaged with the back edge of the seat and is rotatable to a position below horizontal with respect to the elevated stationary seat. A back support is secured to the arm and supports the back of a user sitting on the elevated stationary seat. At least one resistance element is connected to the elevated stationary seat and urges the first arm to an upright start position and assists a user performing an abdominal crunch to return to an upright abdominal crunch position from a fully extended abdominal crunch position with the arm below horizontal with respect to the elevated stationary seat. The resistance element also resists against rotation of the arm away from the upright start position and resists against the user moving from the upright abdominal crunch position to the fully extended abdominal crunch position.

In another embodiment, a resistance chair also includes a second arm having a first end and a second. An adjustable hinge is attached to the first arm and is movable between fixed locations along the first arm. The first end of the second arm is connected to the adjustable hinge and the second end of the second arm is connected to a roller, for example an axle with wheels. Moving the adjustable hinge along the first arm changes a maximum recline angle of the first arm. For example, moving the adjustable hinge upward along the first arm increases the maximum recline angle of the first arm, and moving the adjustable hinge downward along the first arm decreases the maximum recline angle of the first arm.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

Figure 1:
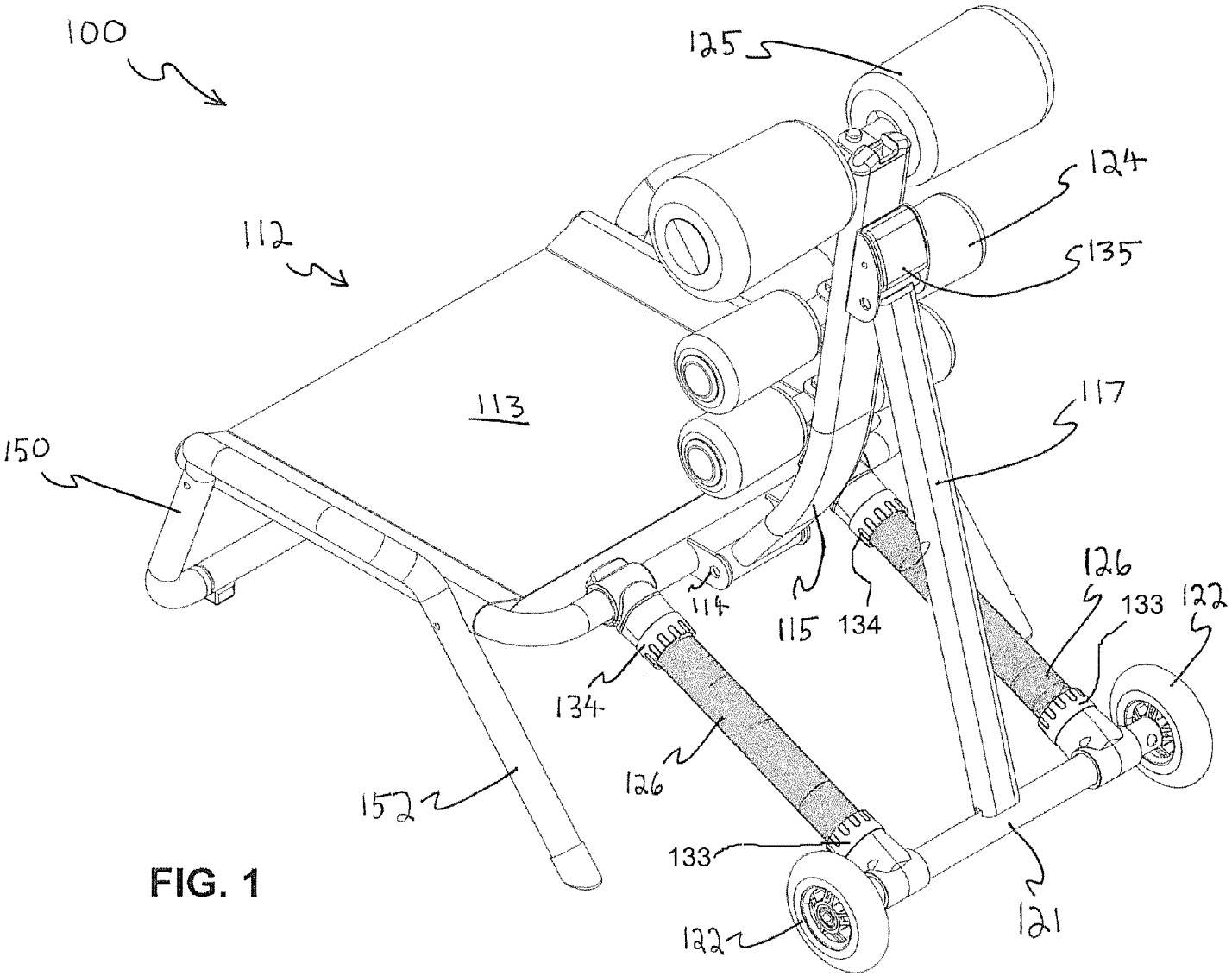
FIG. 1 is a rear perspective view of an alternative embodiment of a resistance chair with an elevated seat.
Figure 2:
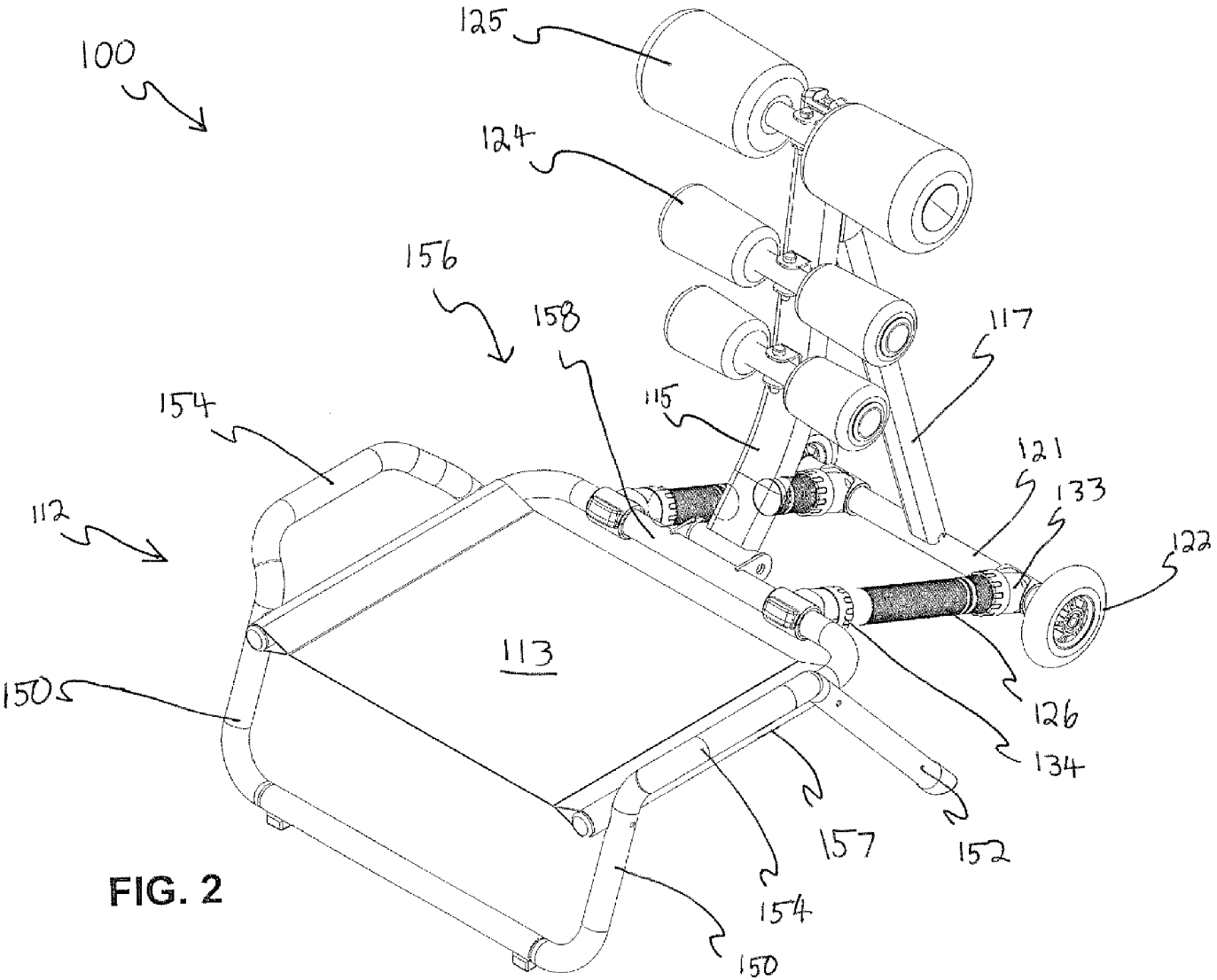
FIG. 2 is a front perspective view of the resistance chair with an elevated seat of FIG. 1.

In one aspect of the disclosed embodiments, an elevated resistance chair includes an elevated stationary seat. By elevating the seat, the user can recline to a position beyond horizontal relative to the seat because the ground (or other support surface) does not prevent the arm from rotating beyond horizontal with respect to the seat. This allows the user to perform more difficult variations of the abdominal crunch because a greater range of motion is permitted. The user's torso being in a position below the seat when in the fully extended abdominal crunch position requires the user to perform a more difficult abdominal crunch as the total range of motion is greater as compared to an abdominal crunch performed while seated on the ground.

As shown in FIGS. 1-5, resistance chair 100 includes elevated seat 112. As opposed to the previously disclosed embodiments, it can be seen that elevated seat 112 is spaced above the ground or other support surface upon which resistance chair 100 is resting. One advantage of spacing elevated seat 112 above the ground is that it allows first arm 115 to recline to a position below horizontal with respect to elevated seat 112. Thus, spacing seat 112 above the ground allows first arm 115 to have a greater range of motion compared to a resistance chair in which the seat rests directly upon the ground rather than spaced above the ground. Elevated seat 112 may be formed by providing a fabric or mesh panel 113 suspended by parallel arms 157 of U-shaped member 156, as shown in the figures. U-shaped member 156 also includes rear support member 158 spanning between parallel arms 157. Alternatively, elevated seat 112 may be a solid flat member made from a suitable material such as plastic or metal.

To spaced elevated seat 112 above the ground, front support legs 150 and rear support legs 152 are provided. Elevated seat 112 is attached to these support rails near the upper ends of front support legs 150 and rear support legs 152. The attachment means may be fasteners such as bolts or screws, welding, adhesive, or any other suitable means. Front support legs 150 and rear support legs 152 may be inclined with their upper ends adjacent elevated seat 112 and their lower ends spaced in front of and behind the front and rear edges of elevated seat 112, respectively. By inclining front support legs 150 and rear support legs 152 relative to vertical, greater stability of elevated seat 112 is achieved. For example, if a user sitting on elevated seat 112 leans or reclines backward, the incline of rear support legs 152 will prevent elevated seat 112 from flipping over. However, it is also contemplated that front support legs 150 and rear support legs 152 may be vertical.

In addition to front support legs 150 and rear support legs 152, horizontal support rails 154 may be provided. Horizontal support rails 154 may be integrally formed with front support legs 152 and rear support legs 154 as depicted in the figures. Alternatively, horizontal support rails 154 may be attached to the upper ends of front support legs 150 and rear support legs 152. Also alternatively, horizontal support rails 154 may be attached to or integrally formed with elevated seat 112. Horizontal support rails 154 may be spaced above elevated seat 112, as shown in the figures, or alternatively may be at the same level as elevated seat 112. Additionally, horizontal support rails 154 may be splayed outward relative to parallel arms 157 of U-shaped member 156, as depicted in the figures. Horizontal support rails 154 are gripped by a user sitting on elevated seat to help brace the user and perform abdominal exercises.

Resistance chair 100 also includes first arm 115 and second arm 117. First arm 115 is hinged about its lower end at hinge 114. At least one shoulder support roller 125 is attached to the front surface of the upper end of first arm 115 for rollably supporting the shoulders of a user sitting on elevated seat 112 and reclining against first arm 115. Similarly, at least one back support roller 124 is attached to the front surface of first arm 115 below the upper end of first arm 115 for rollably supporting the back of a user sitting on elevated seat 112 and reclining against first arm 115. Although shoulder support roller 125 and back support roller 124 are advantageous because they facilitate sliding movement between the user's back and first arm 115 during abdominal exercises, they are not strictly necessary and may be omitted or replaced by non-rolling support members in some embodiments.

The upper end of second arm 117 is hingedly connected to first arm 115 by hinge 135 which is attached to the rear surface of first arm 115 adjacent the upper end of first arm 115. As shown in the figures, hinge 135 may be spaced slightly below the ultimate upper terminus of first arm 115. The lower end of second arm 117 engages with a rolling device such as axle 121. Second arm 117 may be integrally formed with axle 121 as shown in the figures, but in other embodiments second arm 117 and axle 121 may be formed separately and then attached to one another by welding, fasteners, or other suitable means. Axle 121 is rollably supported by rolling means such as wheels 122 that are rollably mounted on each end of axle 121.

Axle 121 is hingedly connected to lower resistance engagement elements 133. For example, as shown in the figures, lower resistance engagement elements 133 may comprise sleeves that wrap around axle 121 so that lower resistance engagement elements 133 may rotate relative to axle 121. Additionally, upper resistance engagement elements 134 are hingedly attached to the rear edge of elevated seat 112. For example, as shown in the figures, upper resistance engagement elements 134 may comprise sleeves that wrap around rear support member 158 of U-shaped member 156 so that upper resistance engagement elements 134 may rotate relative to rear support member 158. Although a pair of lower resistance engagement elements 133 and a pair of upper resistance engagement elements 134 are depicted in the figures, it is to be understood that there may be more or less than two of each of lower and upper resistance engagement elements 133 and 134.

Spanning between lower resistance engagement elements 133 and upper resistance engagement elements 134 are elastic resistance elements 126. In general, there will be the same number of elastic resistance elements 126 as there are lower and upper resistance engagement elements 133 and 134. For example, in the embodiments depicted in the figures, there are two lower resistance engagement elements 133, two upper resistance engagement elements 134 and two elastic resistance elements 126. However, other configurations are also contemplated. For example there may be more or less elastic resistance elements 126 as there are lower resistance engagement elements 133 or upper resistance engagement elements 134 without departing from the general concept of the present disclosure. Examples of possible elastic resistance elements 126 include rubber bands, resistance bands, springs or any other element that is elastic, resists against stretching and tends to return to its original length after stretching forces are no longer applied.

Figure 3:
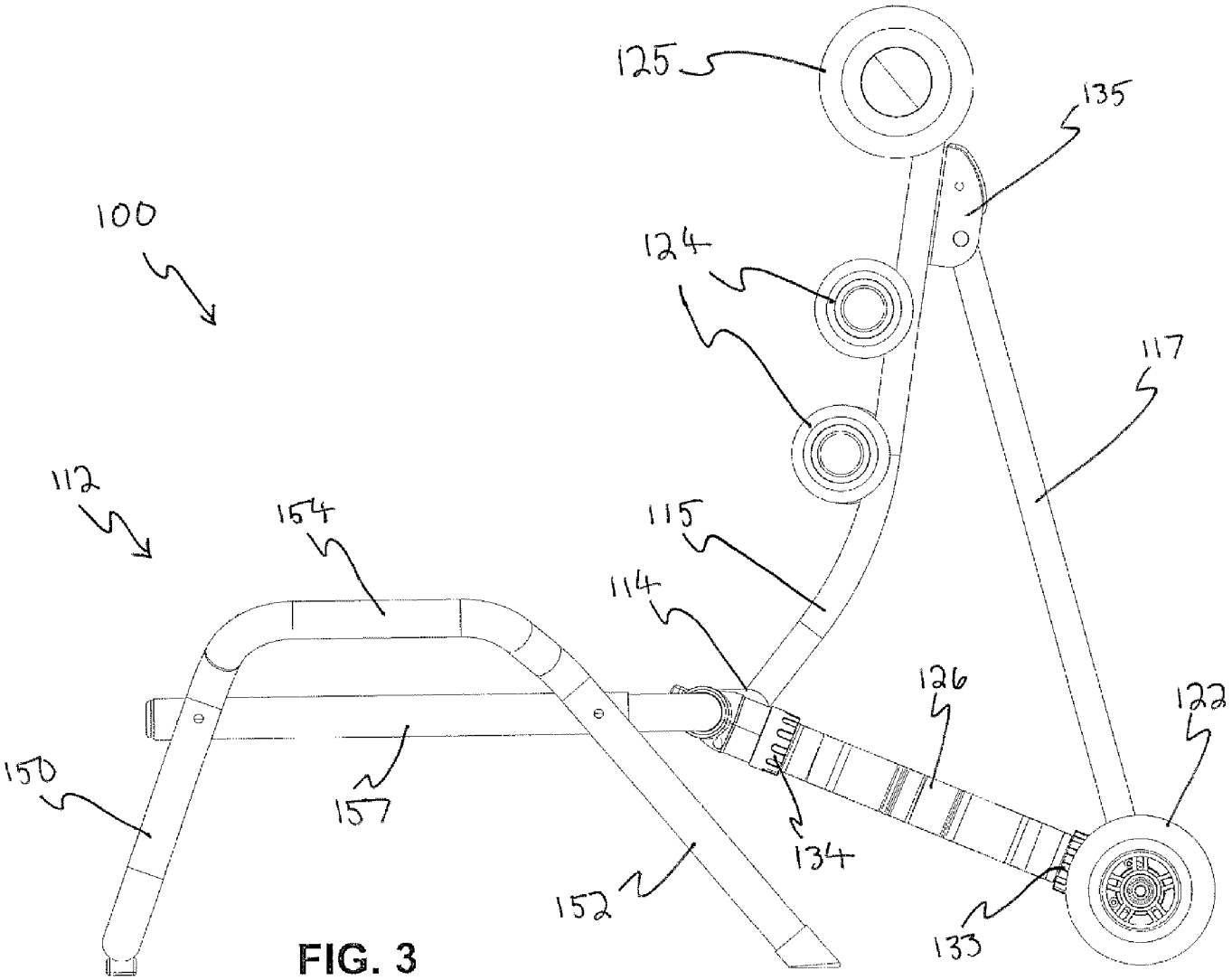
FIG. 3 is a side elevation view of the resistance chair with an elevated seat of FIG. 1.
Figure 4:
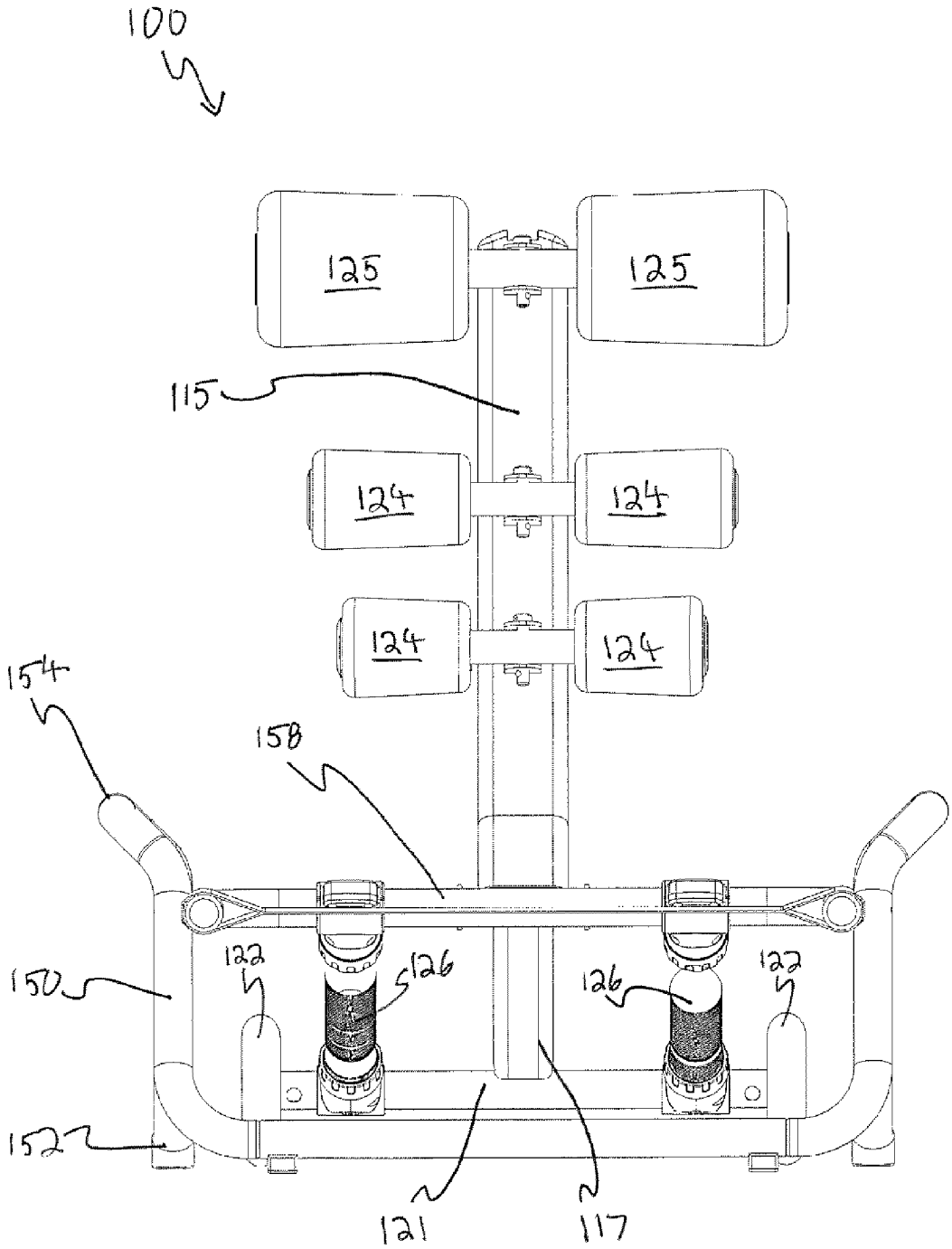
FIG. 4 is a front elevation view of the resistance chair with an elevated seat of FIG. 1.

It can thus be seen that elastic resistance elements 126 resist against reclining first arm 115 (i.e., a counter-clockwise rotation of first arm 117 in FIG. 3). As most clearly shown in FIGS. 3 and 5, as first arm 115 is reclined, the upper end of second arm 117 is forced to rotate about hinge 135 while the lower end of second arm 117 simultaneously moves away from elevated seat 112 due to the rolling of wheels 122. This motion continues until reaching the fully reclined position depicted in FIG. 5. Notably, in the fully reclined position of FIG. 5, first aim 115 is reclined beyond horizontal with respect to elevated seat 112. Once the force causing first arm 115 to be reclined beyond the starting position depicted in FIG. 3 is no longer applied to first arm 115, elastic resistance elements 126 will pull axle 121 back toward elevated seat 112. In general, the force provided by elastic resistance elements 126 is sufficient to return first arm 115 and second arm 117 to the starting position depicted in FIG. 3 if there is no reclining force applied to first arm 115, but is not sufficient to lift a user from the fully reclined position of FIG. 5 to the starting position of FIG. 3. In other words, the user must still use abdominal muscles to return to the starting position, but the force provided by elastic resistance elements 126 will assist the user's upward sit-up motion.

In alternative embodiments, one or more of the structures disclosed above may be adjustable in nature. For example, first arm 115 or second arm 117 may be formed from two telescoping members with multiple apertures that are engageable with a locking pin. By telescoping the two telescoping members to a desired length and engaging the locking pin, a user can vary the length of first arm 115 or second arm 117.

Similarly, the location of hinge 135 on the rear surface of first arm 115 may be adjustable by sliding hinge 135 along first arm 115 and securing the position with a locking pin that engages an aperture in first arm 115. Adjusting the position of hinge 135 varies the difficulty of exercises performed by modifying the starting angle between first arm 115 and second arm 117, and also by changing the starting position of axle 121 relative to elevated seat 112. It can be seen that moving the position of hinge 135 upward along first arm 115 (i.e. away from elevated seat 112) allows for a greater maximum recline angle of first arm 115 in the fully reclined position. Similarly, moving the position of hinge 135 downward along first arm 115 decreases the maximum recline angle of first arm 115. Finally, elastic resistance elements 126 may be adjustable. For example, if elastic resistance elements 126 are multiple resistance bands, it is possible to vary the resistance provided by disengaging one or more resistance bands from lower resistance engagement elements 133 or from upper resistance engagement elements 134.

Figure 5:
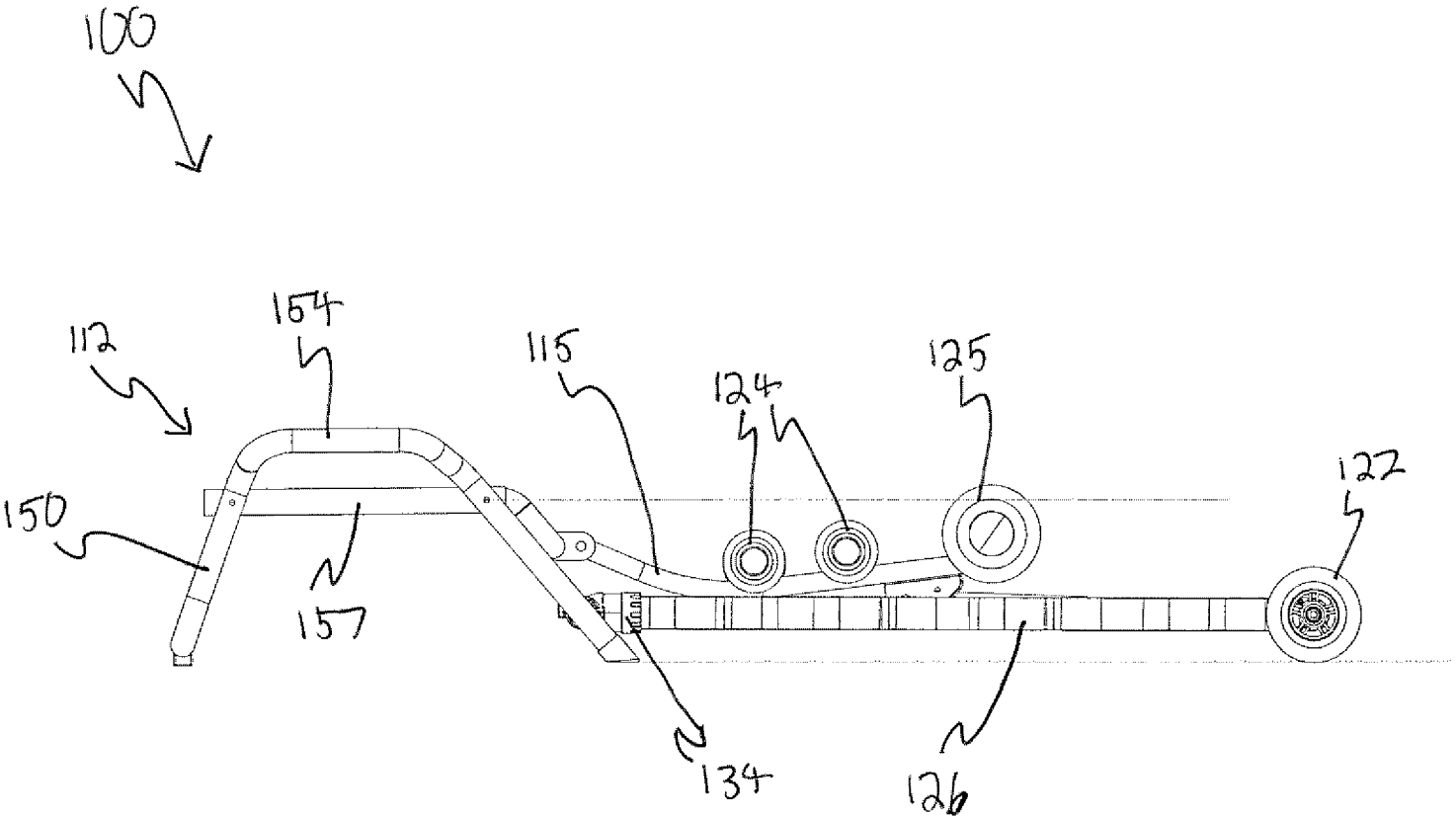
FIG. 5 is a side elevation view of the resistance chair with an elevated seat of FIG. 1, showing the arm rotated beyond horizontal with respect to the elevated seat.

To use resistance chair 100, a user sits on elevated seat 112 with his back and shoulders resting upon back support rollers 124 and shoulder support rollers 125 respectively. The user may grip one or both of horizontal support rails 154 with one or both hands, or not grip horizontal support rails 154 at all. A basic exercise the user can perform is an assisted extended sit-up. The user uses his abdominal muscles to push backwards against first arm 115, a motion which is resisted against by elastic resistance elements 126 pulling against motion of axle 121 away from elevated seat 112. The user continues reclining until any desired position is reached, up to the fully reclined position of FIG. 5. It should be noted that the fully reclined position of FIG. 5 is not possible doing a standard sit-up on the ground with no equipment because the ground prevents the user's torso from reclining beyond horizontal. Once the desired reclined position is reached, the user may then complete the assisted extended sit-up by sitting back up until the starting position of FIG. 3 is reached. The sitting up motion is assisted in this direction by contraction of elastic resistance elements 126 which pull axle 121 toward elevated seat 112. Resistance chair 100 can also be used for other exercises besides abdominal crunches. For example, the user can recline to the fully reclined position of FIG. 5 and perform exercises such as scissor kicks, leg raises, sit and tucks, etc. In particular, it should be noted that these exercises can be performed with a greater range of motion than is possible while seated on the floor. For example, scissor kicks and leg raises can be performed with the users legs having a lowest position that is below horizontal and below the elevated seated of the device.

While the preferred embodiments of the devices and methods have been described in reference to the environment in which they were developed, they are merely illustrative of the principles of the inventions. Other embodiments and configurations may be devised without departing from the spirit of the inventions and the scope of the appended claims.

What is claimed is:

1. A resistance chair for exercising a user's core and abdomen comprising:

an elevated stationary seat comprising a front edge and a back edge;

a front support leg connected adjacent to the front edge;

a rear support leg connected adjacent to the back edge, wherein the front and rear support legs space the elevated stationary seat above the ground;

a first arm rotatably engaging the back edge of the seat and rotatable to a position below horizontal with respect to the elevated stationary seat;

at least one back support secured to the first arm and supporting the back of a user sitting on the elevated stationary seat; and at least one resistance element connected to the elevated stationary seat and a roller, wherein the roller is movable horizontally on the ground, and wherein the at least one resistance element provides vertical and horizontal resistance forces to the elevated stationary seat; and an adjustable hinge attached to the first arm, the adjustable hinge being movable between fixed locations along the first arm;

wherein the at least one resistance element urges the first arm to an upright start position and assists a user performing an abdominal crunch to return to an upright abdominal crunch position from a fully extended abdominal crunch position with the first arm reclined below the elevated stationary seat; and wherein the at least one resistance element resists rotation of the first arm away from the upright start position and resists against the user moving from the upright abdominal crunch position to the fully extended abdominal crunch position with the first arm below the elevated stationary seat.

2. The resistance chair of claim 1, wherein the elevated stationary seat further comprises a pair of opposing hand supports spaced above the elevated stationary seat.

3. The resistance chair of claim 1, wherein the elevated stationary seat comprises a flexible sheet in tension between a pair of parallel rails.

4. The resistance chair of claim 1, wherein the resistance element is angled downwardly and horizontally relative to the elevated stationary seat.

5. The resistance chair of claim 4, wherein the resistance element is an elastic member, wherein the elastic member is an elastic resistance band.

6. The resistance chair of claim 1, further comprising a second arm having a first end and a second end, wherein the first end of the second arm is connected to the adjustable hinge and the second end of the second arm is connected to the roller.

7. The resistance chair of claim 6, wherein moving the adjustable hinge along the first arm changes a maximum recline angle of the first arm.

8. The resistance chair of claim 6, wherein moving the adjustable hinge upward along the first arm increases the maximum recline angle of the first arm, and wherein moving the adjustable hinge downward along the first arm decreases the maximum recline angle of the first arm.

* * * * *